US011535472B2

(12) United States Patent
Hernando Saiz

(10) Patent No.: US 11,535,472 B2
(45) Date of Patent: Dec. 27, 2022

(54) PROCESS AND DEVICE FOR LOADING, UNLOADING AND CONTINUOUS WINDING OF PRODUCT ON A REEL

(71) Applicant: DESARROLLO DE MÁQUINAS Y SOLUCIONES AUTOMÁTICAS S.L., Burgos (ES)

(72) Inventor: Carlos Hernando Saiz, Burgos (ES)

(73) Assignee: DESARROLLO DE MAQUINAS Y SOLUCIONES AUTOMATICAS, S.L., Burgos (ES)

( * ) Notice: Subject to any disclaimer, the term of this patent is extended or adjusted under 35 U.S.C. 154(b) by 135 days.

(21) Appl. No.: 17/048,848

(22) PCT Filed: Apr. 15, 2019

(86) PCT No.: PCT/EP2019/059603
§ 371 (c)(1),
(2) Date: Oct. 19, 2020

(87) PCT Pub. No.: WO2019/201825
PCT Pub. Date: Oct. 24, 2019

(65) Prior Publication Data

US 2021/0122597 A1 Apr. 29, 2021

(30) Foreign Application Priority Data

Apr. 20, 2018 (EP) ..... 18382268

(51) Int. Cl.
*B65H 19/30* (2006.01)
*B65H 19/22* (2006.01)
(Continued)

(52) U.S. Cl.
CPC ..... *B65H 19/30* (2013.01); *B65H 19/2292* (2013.01); *B65H 49/32* (2013.01);
(Continued)

(58) Field of Classification Search
CPC .... B65H 19/30; B65H 19/2292; B65H 49/32; B65H 2301/4173; B65H 67/00
See application file for complete search history.

(56) References Cited

U.S. PATENT DOCUMENTS 4,366,932 A 1/1983 Focke
4,651,942 A * 3/1987 Tomma ..... B65H 19/30 242/542.3

(Continued)

FOREIGN PATENT DOCUMENTS

GB 2244983 A 12/1991

*Primary Examiner* — Sang K Kim
(74) *Attorney, Agent, or Firm* — Hayes Soloway PC

(57) ABSTRACT

The device incorporates a mobile station with: a first shaft to support a movable reel and to actuate rotation of the movable reel around the first shaft; a grip for gripping and releasing the movable reel from a first side of the movable reel closest to the first shaft; and a transporter to move the movable reel in the direction of the first shaft between the mobile station and a loading position. The process handles one single reel in each change, reducing labor and simplifying logistical management of reels. Likewise, the reels are handled from one single side, the side closest to the first shaft. Therefore, space is freed up on the other side, providing more available space.

13 Claims, 4 Drawing Sheets

(51) Int. Cl.
*B65H 49/32* (2006.01)
*B65H 67/06* (2006.01)

(52) U.S. Cl.
CPC ..... *B65H 67/06* (2013.01); *B65H 2301/4127* (2013.01); *B65H 2301/4173* (2013.01); *B65H 2301/414324* (2013.01)

(56) References Cited

U.S. PATENT DOCUMENTS 4,840,321 A * 6/1989 Focke ..... B65H 16/04
242/561
5,031,381 A * 7/1991 Focke ..... B65H 19/123
242/559.2
7,984,603 B2 * 7/2011 Freudenberg ..... B65H 19/123
53/389.2

* cited by examiner

PROCESS AND DEVICE FOR LOADING, UNLOADING AND CONTINUOUS WINDING OF PRODUCT ON A REEL

CROSS-REFERENCE TO RELATED APPLICATIONS AND PRIORITY

This patent application claims priority from PCT Patent Application No. PCT/EP2019/059603 filed Apr. 15, 2019, which claims priority from European Patent Application No. 18382268.3 filed Apr. 20, 2018. Each of these patent applications are herein incorporated by reference in their entirety.

OBJECT OF THE INVENTION

The present invention can be included within the field of continuous winding of reels. More specifically, the present invention relates to a process and device for loading, unloading and continuous winding of product on a reel, that helps to simplify and automate the logistical handling of the reels.

BACKGROUND OF THE INVENTION

In industrial processes in which continuous winding of reels is required, there are collecting systems that comprise two equivalent stations, each of which has a fixed base, on which a transmission system joined to a shaft is supported, wherein at the end of the shaft a plate with a first securing system is arranged. The first securing system is formed by an inner clamp with pneumatic movement. The plate and the second securing system rotate together actuated by the transmission system.

The collecting system further incorporates two guided carriages that transport corresponding reels with a second securing system that is identical to the first securing system, described in the previous paragraph, except in this case it rotates integrally due to the action of a motor, called drive motor of the fixed base.

The transport of the reels by means of guided carriages is not automatic; an operator must move the carriages, with their corresponding reels, one by one, from a loading point to the fixed bases.

On the other hand, to carry out the winding with the system described above, the reels must be held on both sides, the side of the station and the side of the carriage, by means of the two securing systems described above.

Document U.S. Pat. No. 4,366,932 discloses an axially displaceable reel holder for packing machine webs comprising a reel for a web of packaging material, such as metal foil for wrapping cigarettes, which is axially extendable outwardly from the machine base to facilitate web roll replacement. Such extension, and retraction, is implemented by a double acting pneumatic piston and cylinder mounted within the hollow reel axle between a central web of the axle and a surrounding tubular housing. Fine transverse adjustments of the web feed are made by a bidirectional worm driving a rotatable wheel nut in response to output signals from a lateral movement sensing unit.

Document GB2244983 discloses a device for changing rolls of a material, typically in an unwinder of a wrapping machine, comprising a head by which the rolls are taken up singly from a magazine and transferred to an uncoiling station. The head carries three arms radiating from its own axis, which are reciprocated so as to spread or contract by a cam and drive incorporated into the head itself. Freely revolving rollers are mounted one to the end of each arm to grip the periphery of a web roll, their axes being substantially parallel with that of the head. In effecting the transfer movement, the head is traversed both parallel with and transversely to its own axis by respective actuators.

DESCRIPTION OF THE INVENTION

The present invention describes, according to a first aspect, a process for loading, unloading and continuous winding of product on a reel. According to a second aspect, the invention relates to a device for loading, unloading and continuous winding of product on a reel, according to the process referred to.

With regards to that explained in the background, the invention is characterized in that it incorporates transport means and gripping means, which are movable by the transport means, and which automatically move the reel in a back-and-forth movement towards and from a station in which the reel is winded with product.

The device and the process of the invention stand out because, unlike that described above with regard to the state of the art, in order to change the reel after each winding it is only necessary to handle one single reel, while in the state of the art it is necessary to change two reels. As a result, the need for labor is reduced, since, on one hand, it is an automatic system, and on the other hand, the operator has to handle one single reel instead of two. Thus, the automatic handling of the reel is achieved. Likewise, advantages are obtained in the logistical management of the reels, since the number of reels that must be available is reduced.

On the other hand, the invention also stands out because the reels are only handled by the corresponding station thereof on a single side, specifically from the side of the reel which is closest to the station where the winding of the reel is produced. This implies freeing up space on the other side of the rotary table, which entails advantages derived from a more available space.

DESCRIPTION OF THE DRAWINGS

As a complement to the description being made, and for the purpose of helping to make the characteristics of the invention more readily understandable, in accordance with a preferred practical exemplary embodiment thereof, said description is accompanied by a set of drawings constituting an integral part thereof which, by way of illustration and not limitation, represents the following:

FIG. 3A shows a first phase in which the first product is transferred from the movable reel to a non-movable reel, while FIG. 3B shows a second subsequent phase in which the first product is transferred back from the non-movable reel to the movable reel, at the same time that the second product reaches the movable reel.

PREFERRED EMBODIMENT OF THE INVENTION

Figure 1:
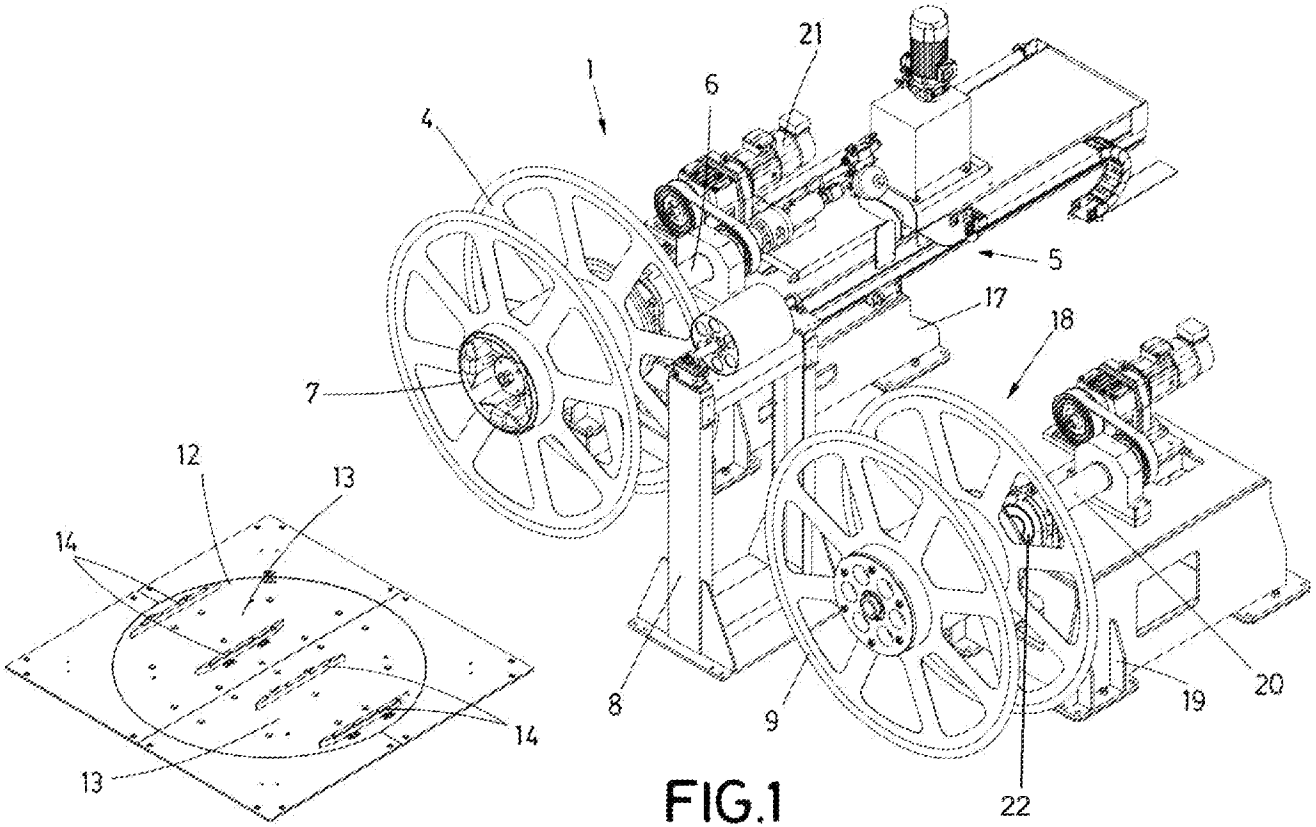
FIG. 1 shows a schematic perspective view of the device of the invention.
Figure 2:
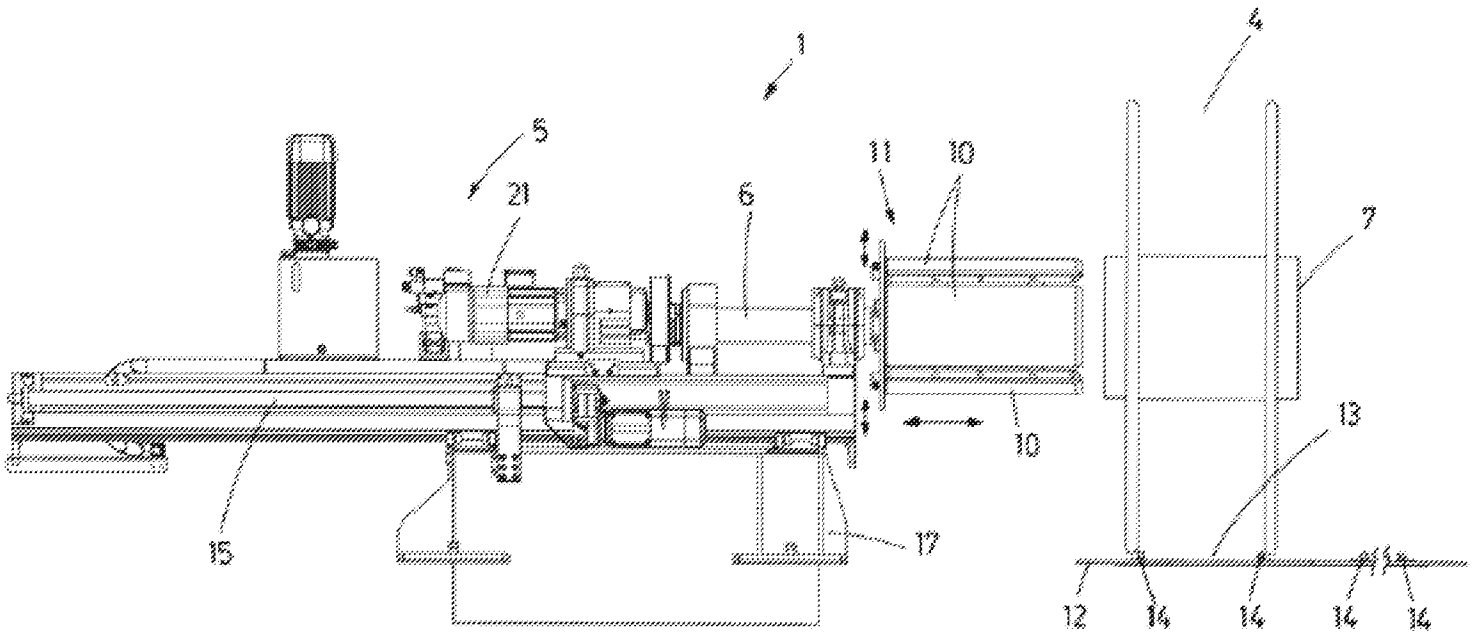
FIG. 2 shows an expanded side view of the transport means in a forward position.

What follows is a detailed description, with the help of the attached FIGS. 1-3 referenced above, of a preferred exemplary embodiment of the object of the present invention.

The invention relates to a process and device for loading, unloading and continuous winding of product on a reel.

Firstly, the device of the invention is explained below.

Figure 3A:
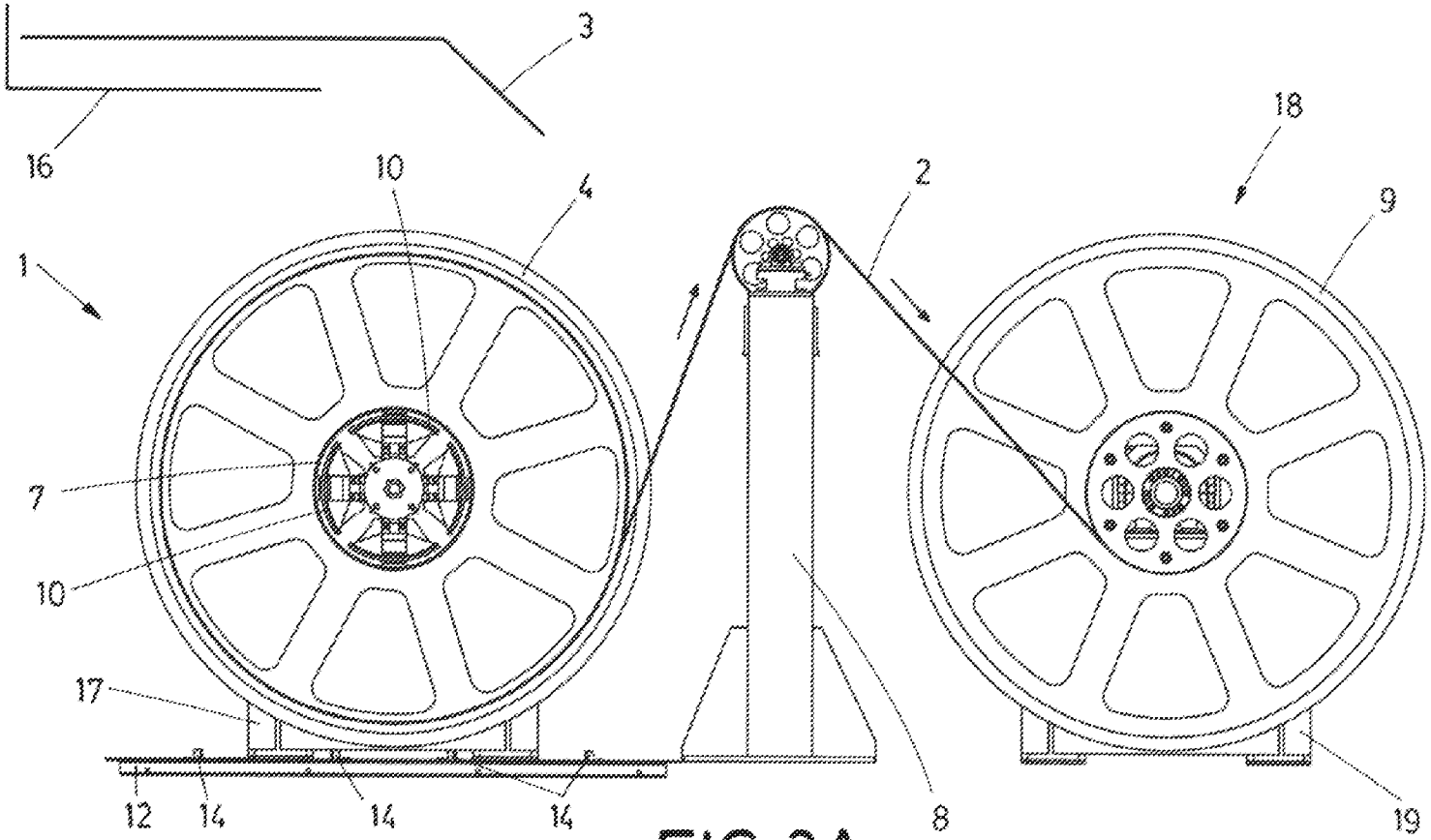
FIGS. 3A and 3B show a schematic representation of an application of the invention when loading the first product and second product in a movable reel, according to a preferred example, where
Figure 3B:
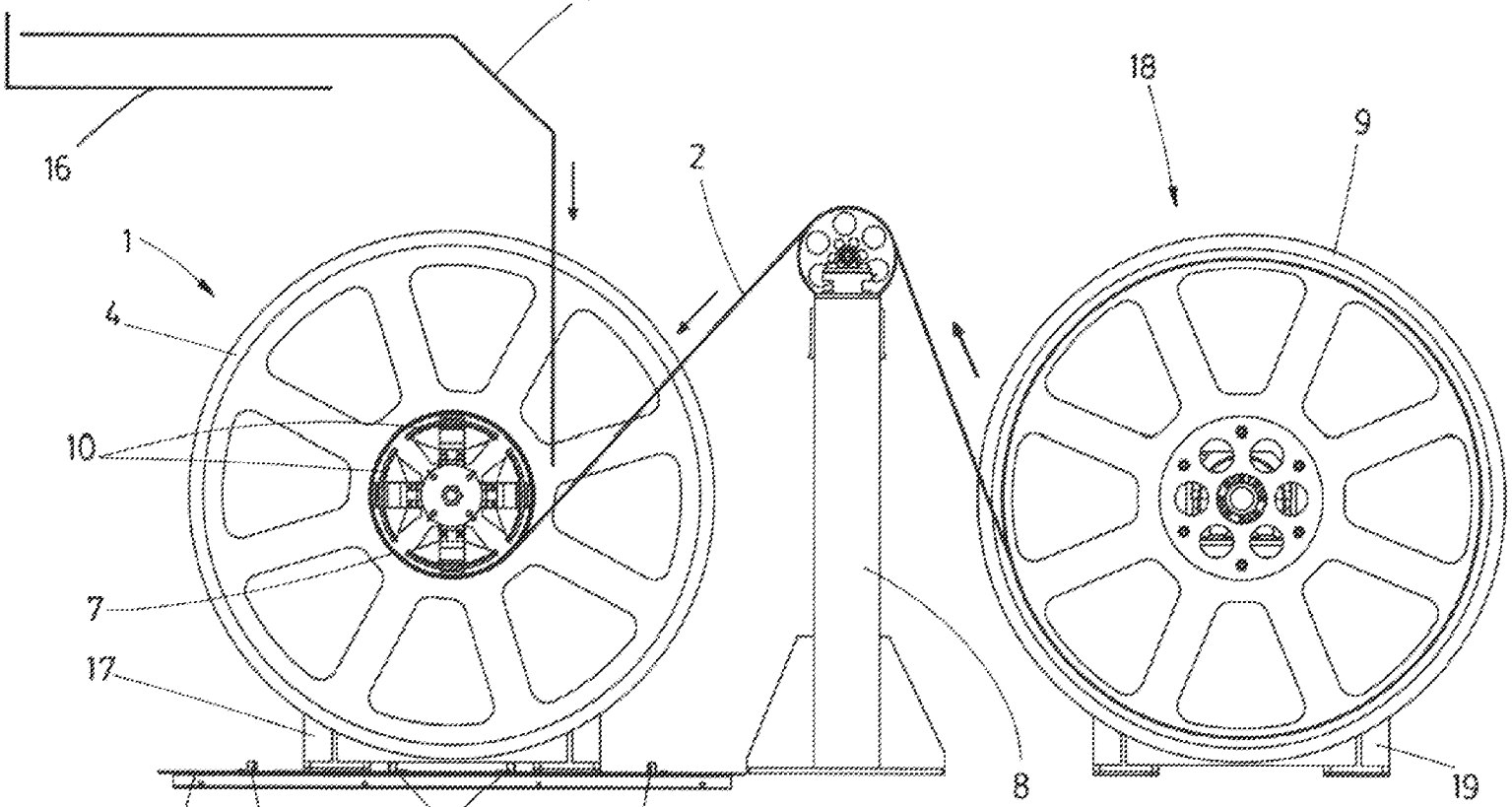

The device of the invention can be generally applied to any industrial process that involves continuous winding of a reel, hereinafter referred to as "movable reel (4)" and therefore, also loading and unloading of said movable reel (4). By way of illustration and not limitation, the device of the invention is described below with regard to a particular application that includes a step in which the movable reel is wound simultaneously with a band of a first product (2) and a band of a second product (3), as shown in FIGS. 3A and 3B.

The device comprises, see FIGS. 1 and 2, a mobile station (1), on which a reel (4), called movable reel (4), is rotatably supported, wherein the movable reel (4) is removable from the mobile station (1), as explained below. In particular, the mobile station (1) comprises a first shaft (6) to support the movable reel (4), the first shaft (6) being able to be actuated by a first transmission system (21) to make the movable reel (4) rotate around the first shaft (6).

The mobile station (1) further includes gripping means (10) for gripping and releasing the movable reel (4) from a first side of the movable reel (4), which is closer to the first shaft (6).

Transport means (15) are used to move the movable reel (4) in the direction of the first shaft (6), in one direction or another, between the mobile station (1) and a loading position, as indicated by the horizontal double arrow of FIG. 2.

Preferably, the mobile station can further comprise a mobile base (5), connected to the transport means (15), and on which the first shaft (6) is assembled, the mobile base (5) being movable in the direction of the first shaft (6) by the transport means (15) in order the move the transport means (15) and the first shaft (6) together. According to a preferred example, the mobile station (1) can further include a first fixed base (17) with respect to which the mobile base (5) can be moved.

As indicated above, the gripping means (10) take and release the movable reel (4) from one single side, called loading side, which is the side closest to the mobile station (1), specifically to the first shaft (6). According to a preferred embodiment, shown in the figures, the gripping means (10) are assembled on the first shaft, preferably on the end of the first shaft (6), for example on a head (11), to be able to be inserted in a central axial gap (7) of the movable reel (4). Preferably, the gripping means (10) can include extendable and retractable clamps, for example in a pneumatic or hydraulic manner, as schematically illustrated by means of vertical double arrows in FIG. 2.

In addition to that described above, the device can include a rotary table (12), preferably automated, arranged on the ground, preferably at ground level. The rotary table (12) faces the first shaft (6) and comprises guides (14) defining at least one housing (13), preferably a plurality of housings (13) to house one or several movable reels (4). The housings (13) are preferably arranged regularly, in other words, angularly equidistant.

The incorporation of a rotary table (12), in particular when it is arranged at ground level, makes it easier to be able to automate the logistics of the movable reels (4), in the movement thereof related to other prior or subsequent processes, for example, by means of the use of AGVs.

Regardless of the number of housings (13), the rotary table (12) is configured to hold a loading position where the movable reel (4) faces the first shaft (6) of the mobile station (1), with the central axial gap (7) thereof aligned with the first shaft (6).

The device can further incorporate, see FIGS. 1 and 3A, 3B a fixed station (18) comprising:

- a second shaft (20) intended to support a non-movable reel (9), the second shaft (20) being able to be actuated by a second transmission system (not shown) to make the non-movable reel (9) rotate around the second shaft (20); and
- a fastener (22) to fasten the non-movable reel (9) to the second shaft (20) to prevent the non-movable reel (9) from moving, limiting the movement of the non-movable shaft (9) to a rotation, without movement outside the fixed station (18).

The fixed station (18) can preferably include a second fixed base (19) on which the second shaft (20) is supported.

The fastener (22) fastens the non-movable reel (9) to the second shaft (20) to prevent the non-movable reel (9) from moving and to enable rotation of the non-movable reel (9) integrally with the second shaft (20). Thus, the non-movable reel (9) can only have rotary movement, without movement outside the fixed station (18).

The device of the invention can be used to simultaneously roll a first product (2) and a second product (3) on the movable reel (4), as explained in detail below.

Thus, the device forms part of an installation in which the first product (2) and the second product (3) can be preferably loaded simultaneously on the movable reel (4). In the example described, the movable reel (4) can be placed and removed from the mobile base (5), in particular, from the first shaft (6), such that the movable reel (4) is preferably already loaded with the first product (2) when it is placed on the mobile base (5); whilst it is loaded with the first product (2) and the second product (3) when it is ready to be removed from the mobile base (5).

On the other hand, the non-movable reel (9) is intended first to receive the first product (2) from the movable reel (4), as shown in FIG. 3A, and subsequently, to move the first product (2) towards the movable reel (4) in a coordinated way with the second product (3), according to FIG. 3B.

According to the above, the non-movable reel (9), according to the example represented, remains on the second fixed base (19), such that it is neither placed nor removed from said second fixed base (19) during the execution of the normal winding operations of the movable reel (4) with the first product (2) and second product (3).

In the example described, the device further and preferably incorporates a transfer system (8), disposed between the fixed station (18) and the mobile station (1), to transfer the first product (2) to the movable reel (4) or to the non-movable reel (9), as the case may be, based on the process that is being carried out.

On the other hand, the second product (3) can be provided, preferably by means of gravity, by letting said second product (3) fall from a conveyor belt (16) onto the first product (2) already held in the movable reel (4).

According to that explained above, the transport means (15) automatically enable the movable reels (4) to move between the mobile base (5) and the rotary table (12) and vice versa.

Next, the process of the invention is explained below.

In general, the process comprises the following steps:

a) arrange in a loading position at least one movable reel (4), facing a first shaft (6) of a mobile station (1) of a device for loading, unloading and winding of product on reels, wherein a loading side of the movable reel (4), closer to the first shaft (6), faces the first shaft (6);

b) transport gripping means (10) from the mobile station (1) by means of transport means (15);

c) grip the movable reel (4) on the loading side with the gripping means (10);

d) the movable reel (4), being gripped, move, by means of the transport means (15), the gripping means (10) together with the movable reel (4) towards the mobile station (1) in the direction of the first shaft (6), in order to house the movable reel (4) inside the first shaft (6) in the mobile station (1);

e) the movable reel (4) being assembled on the first shaft (6) in the mobile station (1), produce winding of product on the movable reel (4); and f) the gripping means (10) being holding the winded movable reel (4) on the loading side, actuate the transport means (15) to move the gripping means (10) together with the movable reel (4) towards the loading position.

According to a preferred example, the movable reel (4) comprises a central axial gap (7), which is aligned with the first shaft (6) in step a).

Preferably, when the movable reel (4) is arranged in the loading position in step a), it is already loaded with a first product (2); as well as step e) comprises the following steps:

e1) hook the first product (2) of the movable reel (4) on a non-movable reel (9) next to the movable reel (4), and start to transfer the first product (2) from the movable reel (4) to the non-movable reel (9) until completely emptying the movable reel (4), according to FIG. 3A; and e2) continuously provide a second product (3) on the movable reel (4), simultaneously to transferring the first product (2) back to the movable reel (4) from the non-movable reel (9), see FIG. 3B.

On the other hand, in the case that the device includes the rotary table (12), step a) can include a first step of loading one or several movable reels (4) in the respective housings (13) and, if applicable, rotating the rotary table (12) to arrange one of the movable reels (4) in the loading position. The loading of the movable reels (4) in the housings (13) can be done manually or automatically, for example by means of AGV.

The process described has a repetitive nature, such that once step f) is completed, the process can be repeated with a new movable reel (4). Thus, arranging a movable reel (4) in a loading position according to step a) can be carried out in several ways. According to a preferred example, the rotary table (12) has several housings (13), such that rotation of the rotary table (12) leaves a new movable reel (4) in a loading position. Other alternative solutions can be considered.

The invention claimed is:

1. A process for loading, unloading and winding of product on a reel, comprising the following steps:

a) arranging in a loading position at least one movable reel, already loaded with a first product, facing a first shaft of a mobile station of a device for loading, unloading and winding of product on reels, wherein a loading side of the movable reel closer to the first shaft, faces the first shaft;

b) transporting a gripping means from the mobile station with a transport means;

c) gripping the movable reel, from one single side, the loading side, with the gripping means;

d) moving the gripping means and the movable reel towards the mobile station in the direction of the first shaft using the transport means;

e) assembling the movable reel on the first shaft in the mobile station, e1) hooking the first product of the movable reel on a non-movable reel next to the movable reel, and starting to transfer the first product from the movable reel to the non-movable reel until completely emptying the movable reel; and e2) continuously providing a second product on the movable reel, to simultaneously transfer the first product back to the movable reel from the non-movable reel; and f) the gripping means holding the winded movable reel on the loading side, and actuate the transport means to move the gripping means together with the movable reel toward the loading position.

2. The process of claim 1, wherein the movable reel has a central axial gap, wherein the central axial gap is aligned with the first shaft in step a).

3. The process of claim 2, wherein step b) comprises using the transport means to move in the direction of the first shaft, a mobile base of the mobile station, on which the first shaft and the gripping means are assembled.

4. The process of claim 1, wherein step b) comprises using the transport means, to move in the direction of the first shaft, a mobile base of the mobile station, on which the first shaft and the gripping means are assembled.

5. A device for loading, unloading and winding of product on a reel, using the process of claim 1, wherein the device comprises:

the mobile station comprising:

the first shaft to support a movable reel, the first shaft being able to be actuated to make the movable reel rotate around the first shaft;

the gripping means for gripping and releasing the movable reel from a first side of the movable reel, which is closer to the first shaft; and the means to move the movable reel in the direction of the first shaft between the mobile station and a loading position, a fixed station comprising:

a second shaft intended to support the non-movable reel, the second shaft being able to be actuated to make the non-movable reel rotate around the second shaft; and a fastener to fasten the non-movable reel to the second shaft to prevent the non-movable reel from moving, limiting the movement of the non-movable shaft to a rotation, without movement outside the fixed station.

6. The device of claim 5, wherein the mobile station further comprises a mobile base, connected to the transport means, and on which the first shaft and the gripping means are assembled, the mobile base being movable in the direction of the first shaft by the transport means in order the move the gripping means and the first shaft together.

7. The device of claim 6, wherein the gripping means are assembled on the first shaft.

8. The device of claim 7 wherein the gripping means comprise extendable and retractable clamps.

9. The device of claim 7, wherein the gripping means are assembled on one end of the first shaft and both are configured to be housed in a central axial gap of the movable reel.

10. The device of claim 6 wherein the gripping means comprise extendable and retractable clamps.

11. The device of claim 6, wherein the gripping means are assembled on one end of the first shaft and both are configured to be housed in a central axial gap of the movable reel.

12. The device of claim 5, wherein the gripping means comprise extendable and retractable clamps.

13. The device of claim 5, wherein the gripping means are assembled on one end of the first shaft and both are configured to be housed in a central axial gap of the movable reel.

* * * * *